United States Patent [19]

Yanagioka

[11] 4,188,032

[45] * Feb. 12, 1980

[54] NICKEL-PLATED GOLF CLUB SHAFT MADE OF FIBER-REINFORCED PLASTICS

[76] Inventor: Seiichi Yanagioka, No. 284-1, Shindo, Hiratsuka-shi, Kanagawa-ken, Japan

[ * ] Notice: The portion of the term of this patent subsequent to May 30, 1995, has been disclaimed.

[21] Appl. No.: 790,343

[22] Filed: Apr. 25, 1977

[30] Foreign Application Priority Data

May 19, 1976 [JP] Japan ..... 51-62573[U]

[51] Int. Cl.[2] ..... A63B 53/10

[52] U.S. Cl. ..... 273/80 R

[58] Field of Search ..... 273/67 R, 72 R, 72 A, 273/73 R, 73 C, 73 E, 73 K, 82 R, 82 A, 80 R, 80 B, 80.9, DIG. 1–DIG. 12; 428/379, 389; 29/191, 197; 427/306, 438; 204/37, 49

[56] References Cited

U.S. PATENT DOCUMENTS

| | | | |
|---|---|---|---|
| 1,615,232 | 1/1927 | Pryde et al. | 273/80 R X |
| 1,680,447 | 8/1928 | Bryant | 273/80 R |
| 1,848,374 | 3/1932 | Morgan | 273/80 R |
| 2,195,681 | 4/1940 | Robarge | 273/72 R |
| 3,083,968 | 4/1963 | Takahashi | 273/73 R |
| 3,782,978 | 1/1974 | Souza | 29/197 X |
| 3,830,496 | 8/1974 | Reizer | 273/72 R |
| 4,014,542 | 3/1977 | Tanikawa | 273/72 R |
| 4,092,025 | 5/1978 | Yanagioka | 273/72 R |

FOREIGN PATENT DOCUMENTS

| | | | |
|---|---|---|---|
| 275811 | 8/1927 | United Kingdom | 273/80 B |

*Primary Examiner*—Richard J. Apley
*Attorney, Agent, or Firm*—Fay & Sharpe

[57] ABSTRACT

A golf club shaft is provided which includes an elongated body having one end adapted to the grip and the opposite end attached to a golf club head, the elongated body being composed of fiber-reinforced plastic material having on substantially its entire outer surface a metallic plating selected from the group consisting of nickel and nickel based alloys.

1 Claim, 1 Drawing Figure

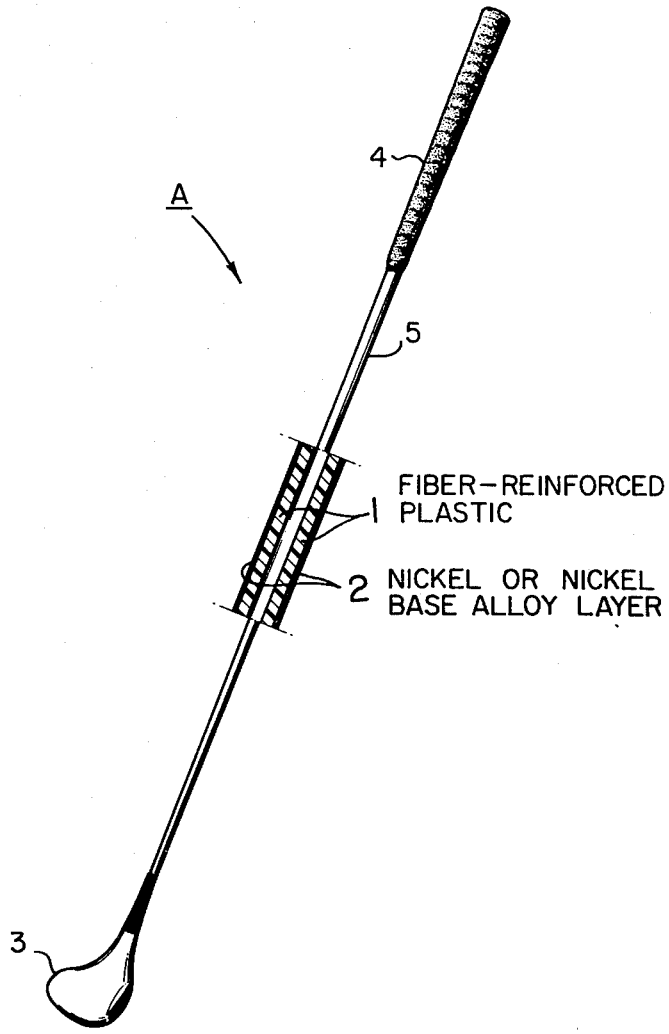
A
4
5
FIBER-REINFORCED PLASTIC
1
2
NICKEL OR NICKEL BASE ALLOY LAYER
3

NICKEL-PLATED GOLF CLUB SHAFT MADE OF FIBER-REINFORCED PLASTICS

This invention relates to an improvement in or relating to a golf club shaft made of fiber-reinforced plastics.

It is known that conventional shafts for golf clubs have been made of metals such as steel and/or light alloys, and that recently golf club shafts have been made from fiber-reinforced plastics because they are superior to metals in corrosion resistance and strength. Today plastics reinforced with carbon fibers are used, which are higher than metals in elastic proportion, thereby enhancing the efficiency of golf club.

However, there are various disadvantages associated with fiber-reinforced plastics in that since the matrix of golf club is made of epoxy resin or other synthetic resins these resins are extremely inferior in hardness to metals, producing inferior strength over wear, that flaws are produced on the surface of the golf club through continuous contact with the turf or other obstacles when hitting ball during golf play, thereby causing rough and uneven surfaces to be formed on the club.

The object of the present invention is to effect a surface treatment to such a high efficient shaft to prevent it from wearing. That is, there is provided, as a wear-resistant substance, a plated layer of nickel or nickel alloy on the shaft of the fiber standpoint.

The hardness of nickel is higher than that of structural steels. Brinell hardness of nickel being 250–500 and those of nickel-phosphorus alloy and nickel-boron alloy being more than 400. In addition nickel is an excellent casting for plastics. Plating layers of chrome, tungsten, rhodium or the like whose hardness are higher than nickel is likely to come off in use, and soft metals such as copper, tin, lead and zinc are inferior to plastics in wear resistancy, so that nickel is best suited for plating film. As regards applying nickel by techniques other than plating, lack of durability so as not to be usable in practice. Nickel-plated film is characterized by its toughness and hardness in that it adapts itself to the curved surface of the plastic shaft and is sufficiently curved against the impact by grass or earth and sand when swinging. Further, nickel-phosphorus alloy or nickel-boron alloy is capable of enhancing its hardness by a heat treatment so that it is possible to improve the surface hardness through heating treatment in a non-interferable range in consideration of thermal properties of plastic element.

With regard to the specific plating method employed, there can be obtained a deposited layer having similar properties through any of well known electrolysis and non-electrolysis processes, but plating by non-electrolysis method may produce the most excellent deposited layer.

The plastics utilized may be reinforced with glass fiber, asbestos fiber, carbon fiber and the like in the form of cotton, cloth, twisted yarn, felt, etc. alone or in blended or mixed spinning. If preferable there may be added other organic fibers such as epoxy resin, polyester resin, nylon, ABS resin and other thermosetting and thermoplastic resins.

Furthermore, the present invention is applicable even to metallic pipes in which reinforced plastics are overlaid.

The plating of the shaft can be carried out by way of the following example.

(1) Element: Epoxy resin reinforced with glass cloth mixed with carbon fiber (2) Plating:

(i) Etching by aqueous solution of chromic acid anhydride and dilute sulphuric acid (Water-washing process)

(ii) Activation by aqueous solution of palladium chloride (Water-washing process)

(iii) Nickel plating by non-electrolysis

Bath composition:

Nickel pyrophosphate 26.7 g/l.

Orthoboric acid 1.2 g/l.

Ammonium sulfate 2.6 g/l.

Sodium acetate 4.9 g/l.

pH: 5.7 Plating temperature: 21° C.

Plating time: 20 Hrs.

Through the above treatment the following plating film was produced.

Thickness of plated layer: 20μ

Composition of plated layer: 6.5% P—Ni alloy

Hardness of plated layer:

When just plated: 450 in Vickers

After drying and heating at 120° C.: 600 in Vickers

The accompanying drawing shows a prospective view of a golf club A having an enlarged sectional view B which is partly in section of the golf club shaft which is made of fiber-reinforced plastics and plated with a layer nickel according to the present invention. In the drawing reference numeral (1) designates an element of fiber-reinforced plastics, reference (2) a deposited layer of nickel or its alloy respectively reference (3) the club head, reference (4) the club handle grip, and reference (5) the club shaft.

I claim:

1. A golf club shaft comprising an elongated body having one end adapted to be gripped and an opposite end adapted to be attached to a golf club head, said elongated body composed of fiber-reinforced plastic material having on substantially its entire outer surface a metallic plating selected from the group consisting of nickel and nickel based alloys.

* * * * *

UNITED STATES PATENT AND TRADEMARK OFFICE

CERTIFICATE OF CORRECTION

PATENT NO. : 4,188,032

DATED : February 12, 1980

INVENTOR(S) : Seiichi Yanagioka

It is certified that error appears in the above—identified patent and that said Letters Patent is hereby corrected as shown below:

In the patent heading, the following patent assignment data is added following the line identified as [76] Inventor:

Assignee: Aikoh Co., Ltd.
Tokyo, Japan

Signed and Sealed this

*Twenty-second* Day of *July 1980*

[SEAL]

*Attest:*

SIDNEY A. DIAMOND

*Attesting Officer*

*Commissioner of Patents and Trademarks*